United States Patent [19]

Taniguchi et al.

[11] Patent Number: 4,614,461

[45] Date of Patent: Sep. 30, 1986

[54] TENDON OF TLP AND ELECTRICAL CORROSION PROTECTING METHOD OF THE SAME

[75] Inventors: Yasuyuki Taniguchi, Kimitsu; Kotaro Yoshida, Sagamihara; Yasuhira Takeshi, Sagamihara; Teruo Michishita, Sagamihara; Michio Kawai, Kitakyushu; Makoto Kawakami, Sagamihara, all of Japan

[73] Assignee: Nippon Steel Corporation, Tokyo, Japan

[21] Appl. No.: 772,743

[22] Filed: Sep. 5, 1985

[30] Foreign Application Priority Data

Sep. 7, 1984 [JP] Japan ..... 59-186564
Nov. 16, 1984 [JP] Japan ..... 59-241950

[51] Int. Cl.[4] ..... C23F 13/00; E02B 17/00; B63B 35/44

[52] U.S. Cl. ..... 405/211; 204/148; 204/197; 405/195

[58] Field of Search ..... 405/211, 216, 195, 224; 204/197, 196, 148, 147

[56] References Cited

U.S. PATENT DOCUMENTS

| | | | |
|---|---|---|---|
| 3,232,857 | 2/1966 | Caldwell | 204/197 |
| 3,418,230 | 12/1968 | Rutemiller | 204/197 |
| 3,887,449 | 6/1975 | Baer | 204/148 |
| 4,284,488 | 8/1981 | Brittain et al. | 204/197 |
| 4,285,615 | 8/1981 | Radd | 405/211 |
| 4,415,293 | 11/1983 | Engel et al. | 405/211 X |
| 4,484,840 | 11/1984 | Nandlal et al. | 405/211 |
| 4,506,485 | 3/1985 | Apostolos | 405/216 X |
| 4,540,314 | 9/1985 | Falkner | 405/224 X |

*Primary Examiner*—Dennis L. Taylor
*Attorney, Agent, or Firm*—Kenyon & Kenyon

[57] ABSTRACT

The tendons of a tension leg platform (TLP) used for producing petroleum offshore at a depth of 400–1000 m are protected against fatigue corrosion which mainly determines the life of the tendons.

The straight steel pipes (1) have an insulative, corrosion-protection coating (8) having good damage resistance. The screw couplings (2) have a sprayed aluminum layer (9) having the ends contiguous to the ends of the insulative, corrosion-protection, and a galvanic current anode (5) is electrically connected to the screw coupling (2).

7 Claims, 8 Drawing Figures

TENDON OF TLP AND ELECTRICAL CORROSION PROTECTING METHOD OF THE SAME

BACKGROUND OF INVENTION

1. Field of the Invention

The present invention relates to a tendon of a tension leg platform (hereinafter referred to as the TLP) for producing offshore petroleum and gas. The present invention also relates to a method for electrical corrosion-protection for the tendon of the TLP.

Tendons are members used for anchoring the platform of a TLP to the sea bottom and are made of the coupled steel pipes.

2. Description of the Related Arts

Recently, investigations into petroleum and gas resources have extended into areas where the sea is deep. The problems to be solved at present are how to provide a structure which can be installed offshore at a water depth of 400~1000 m as a conventional scaffolding type-offshore structure is considered to be unable to meet the requirements for an offshore structure installed at such a water depth. Various offshore structures, said to exceed the limitations of the conventional scaffolding type, have been proposed. The TLP is considered to be one of the most promising of the structures which meet the requirements mentioned above and, hence, practical utilization thereof has begun. In this regard, steel pipes have not been used heretofore for anchoring a platform or the like to the sea bottom in deep areas. In addition, since the steel pipes of a tendon are extremely difficult to maintain, the steel material used for tendons must have a high mechanical durability. Another problem is how to protect the tendons from corrosion for a target life of from 20 to 30 years.

The Japanese technical journal "Piping and Plant" (March, 1981) illustrates one example of corrosion-protection of an offshore structure (c.f. page 34, right column, lines 6–9 and Table 4). That is, the parts of tendons immersed in seawater are galvanically corrosion-protected, and the upper parts of tendons above the ebb and flow level have a thin coating applied on a zinc-rich paint undercoat. When this corrosion-protection method is applied for tendons which are immersed in seawater, the tendons are galvanically corrosion-protected over their entire length and surface. Such an application will now be considered in more detail.

A tendon is manufactured by connecting steel pipes. In order to attain a uniform corrosion-protection potential over a length of 400 m or more, a galvanic current-anode (sacrificing anode) system, in which the power sources are dispersed, is more advisable than an external power-system using a centralized power source. Assume that the tendons are corrosion-protected for service over 30 years in a southern area of the northern Sea by using aluminum anodes, each of which is attached to a steel pipe 500 mm in diameter and 12 m in length, the net weight of each aluminum anode is presumably 340 kg.

Another approach, i.e., using only the paint coating system, is now described. Long term durability of a coating when immersed in sea water cannot be expected, when the coating must be thin enough to be applied on the upper part of a conventional offshore structure above sea-level, since such coating is likely to be damaged. A coating life 30 years can be realized if the coating is thick and thus will resist damage. The thick coating involves, however, a problem of whether or not the coating can be thickly applied on the steel pipes, in situ, during their installation off shore. The thick application appears to be unlikely, since the installation must be conducted continuously and this can be carried out only when the sea is calm. Another problem involved is that, although a coating can be formed in the factory on a major portion of a tendon, the screws used for coupling the steel pipes remain uncoated, and further, if the coating is preliminarily applied on the screws, it may be damaged by a fastening jig, e.g., a tongue for fastening the couplings to the steel pipes. Still another problem is that such a coating is generally consiered to be less durable than the galvanic corrosion-protection. A further problem is that the coating, which may be selectively applied on the straight section of a tendon or be extended to the coupling parts of a tendon, has a low durability at the edges thereof.

"Ocean AGe" (December, 1983) discloses that corrosion-protection of tentons exxclusively by the flame sprayed aluminum (FSA) process was tentatively conducted. However, a wait of several years would appear necessary to decide whether or not such protection is appropriate.

As is described above, an appropriate long-term corrosion protection is not attained by readily applying the prior art to the corrosion protection of the tendons. In summary, the corrosion-protection of tendons should fulfull the following requirements.

A. A corrosion-protection coating should have a durability and a damage resistance conforming to parts of the tendons.

B. Deterioration of a corrosion-protection coating should not occur at the edges of coating.

C. An anode of the galvanic corrosion-protection system should be as small in size as possible.

D. An anode should be connected to the tendon in a durable manner over a long period of time.

E. Steel pipes should be rust-proof treated prior to installation of tendons.

F. Application of a coating should be omitted, in situ, at installation of tendons.

The prior art of galvanic corrosion protection is now further described.

Unlike the conventional scaffolding structure, the tendons are subjected to great tension in sea water, since the TLP is in a state of continual movement due to wave action, and thus fatigue corrosion of the tendons is likely to occur. The galvanic corrosion-protecting method is effective for drastically lessening fatigue corrosion, as described in OTC paper No. 4449 (May, 1983) (c.f. FIG. 7). The galvanic corrosion-protection therefore can be advantageously used for protecting tendons, irrespective of whether it is used alone or in combination with the coating method. However, on the question of whether galvanic corrosion-protection is reliable, "Ocean Age" (December 1983) refers to the fact that fatigue corrosion is liable to occur at the parts of a galvanic-current anode where it is welded to the steel pipe (c.f. from page 54, right column, line 17 to page 55, left column, line 6 and FIG. 9). This fatigue corrosion occurs because, since a galvanic current-anode, which is a small-sized member, is locally welded, the galvanic current-anode is liable to harden and the stress is liable to be concentrated on the fixed ends of the galvanic current anode. According to a conventional galvanic current anode system, the core metal of the anode is fillet welded to the steel pipe to be protected. If this fillet welding is readily applied for the corrosion protection of tendons, not only would serious fatigue corrosion occur, but also the galvanic current anodes per se would fall off of the tendons during the service. Accordingly, when the galvanic current-anode system is applied for corrosion-protecting tendons, the galvanic current-anodes must be attached to the tendons in such a manner that the fatigue corrosion characteristic of the tendons are not seriously influenced and further, that the galvanic current-anodes do not fall off after a long period of time. Unless such attachment is accomplished, the intended corrosion-protection can not be attained, but instead, fatigue corrosion would be caused by the attachment of the galvanic current-anodes.

SUMMARY OF THE INVENTION

In the present invention, a complex, galvanized and coating-corrosion protection is applied to the tendons, whereby the tendons are provided with an insulative corrosion protection coating having a good damage resistance on the straight section thereof, and a sprayed aluminum layer is applied on the outer surface thereof. Also, in the present invention, the welding point of a galvanic current-anode is offset from the line of stress applied to the tendon and, further, butt welded steel materials are used at the welding point.

In accordance with the present invention, there is provided a tendon of a TLP, wherein the tendon comprises straight steel pipes, each having screw couplings at the ends thereof, each screw coupling having convex and concave parts on the circumferential part thereof, for fastening the screw coupling, characterized in that the straight steel pipes have an insulative, corrosion-protection coating having a good damage resistance, on the outer surface thereof, and, the screw couplings have, on the outer surface thereof, a sprayed aluminum layer, the ends of which are contiguous to the ends of the insulative, corrosion-protection layer and, further, the straight steel pipes are provided with a galvanic current-anode attached thereto and therearound.

In accordance with the present invention there is provided an electrical protection method for a tendon of a TLP, wherein the tendon comprises straight steel pipes, each having screw couplings at the ends thereof, each screw coupling having convex and concave parts on the circumeferential part thereof, for fastening the screw coupling, characterized in that at least one of said screw couplings at the ends of each straight steel pipe is provided with a projection in a rod form, which protrudes from the convex parts of the screw couplings and which consists of the same material as that of the screw couplings and, further, a galvanic current-anode, which is wound around and attached to the straight steel pipes or the screw couplings, has a core metal part made of steel and is butt-welded to each projection in the form of a rod.

DESCRIPTION OF THE PREFERRED EMBODIMENTS

Figure 1A:
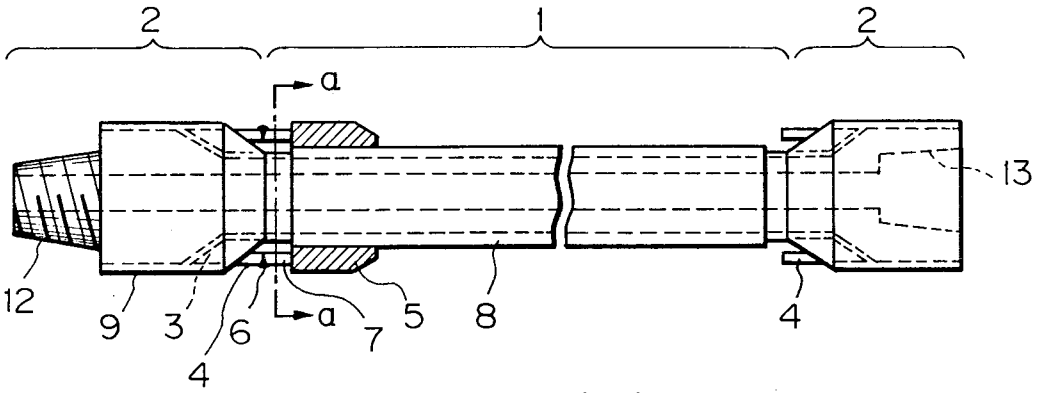
FIG. 1(A) is a side view of an embodiment of the tendon according to the present invention and FIG. 1(B) is a cross sectional view taken along the line a—a in FIG. 1(A)
Figure 1B:
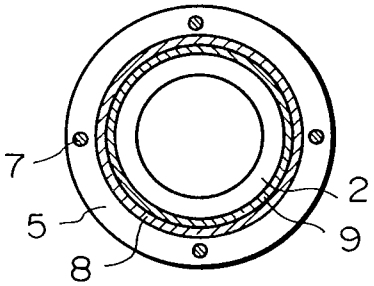
Figure 2A:
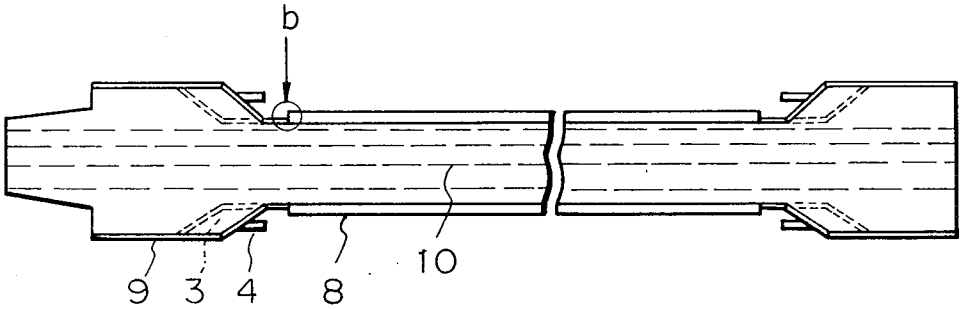
FIG. 2(A) is a longitudinal cross sectional view of the tendon shown in FIG. 1(A)

Referring to FIG. 1, the tendon according to the present invention comprises a straight steel pipe 1 and screw couplings 2. The screw couplings 2 have a spline 3 for fastening the section 2 to a neighbouring straight steel pipe (not shown). The concave and convex parts of the spline 3 are arranged circumferentially and virtually equi-distant from each other on the body of couplings. The convex parts of the spline 3 have a plurality of projections 4 in the form of a rod, which are extended from a part of each convex part of the spline 3 and which are arranged circumferentially and virtually equi-distant from each other. The straight steel pipe 1 is provided with a galvanic current-anode 5, which is made of an appropriate anode metal, and is wound around in the form of a ring (so-called bracelet form) and attached to the straight steel pipe 1. In the embodiment of the galvanic current-anode 5 shown in FIGS. 1(A) and 1(B), metallic core members 7 are rigidly secured to the galvanic current anode 5 and are welded to the ends of the projections 4 through the weld zone 6. The weld zone 6 is located at a position such that it is not influenced by the stress acting lines 10 (FIG. 2(A)), and thus, there is no danger that the weld zone 6 will act as a notch and cause the destruction of the tendon. The attachment of the galvanic current-anode 5 to the straight steel pipe 1 is in no way limited to the embodiment as shown in FIG. 1(A) but may be any way, in which the attached zone will not act as a notch and cause the destruction of the tendon. The straight steel pipe 1 comprises, on its outer surface, a coating 8 having a good damage resistance and being insulative. The screw couplings 2 have, on the outer surface thereof, the sprayed aluminum layer 9. The ends of the coating 8 are in contact with the ends of the sprayed aluminum layer 9. The former and latter ends may butt against one another or may overlap one another. According to the embodiment of the tendon shown in FIGS. 1(A) and (B), one unit of the pipe and coupling-assembly has a male screw 12 at one end and a female screw 13 at the other end. According to another embodiment, units of the pipe and coupling-assembly having female screws at both ends, and other units having male screws at both ends are alternately connected with each other.

The coating 8 according to the present invention is further described. The "insulative" property of coating 8 is that of an electric insulator. The "good damage resistance" of coating 8 is that it has sufficient strength and flexibility so as to resist impact and sway exerted on the straight steel pipe 1 prior to, during, and subsequent to, installation or assembly. The coating 8 should have a corrosion protection with a life-expectancy of 20 years or longer or 30 years or longer. The coating 8 may be a 0.2 mm or more thick layer of an insulative epoxy resin. This coating is appropriate for corrosion protection with a life-expectancy of 30 years. The coating 8 may also be a 1 mm or more thick layer of an insulative polyethylene resin. This coating is also appropriate for corrosion protection with a life-expectancy of 30 years. In order to enhance the damage resistance of these coatings, the layer thickness should be adjusted to 2 mm or more for the polyethylene resin coating, and the epoxy resin layer should be provided with a protective layer which can consist of polyurethane, polyester reinforced with glass, polymer cement or mortar, or resin mortar. The polymer cement or mortar consists mainly of cement or mortar and contains a small amount of anti-crazing agent, such as acrylic polymer or SB rubber. The resin mortar consists of paint, and usually the paint is mainly composed of organic synthetic resin, e.g., epoxy resin, into which a large amount of sand ($SiO_2$) is added. The resin mortar is free of cement. The protective layer has usually a thickness of 2 mm or more. The coating 8 is preferably a laminate of a thin epoxy layer and a thick polyurethane layer or a thick layer of polyethylene having a thicknes of 2 mm or more in the light of the respective characteristics of the coating 8. The thin epoxy layer can be applied on the straight steel pipe by means of various methods, such as spraying, continuous-flow curtain coating, and electrostatic coating. The paint used for thin epoxy layer may be a solvent-based coating, two-pack type coating or powder coating. The thick polyurethane coating may be formed by means of spraying, continuous-flow curtain coating, or by molding the two-pack urethane. The thick polyethylene coating can be applied on the straight steel pipe 1 by means of fluidization dip coating of the powder coating, or dispersing or melt-extruding the powder coating. Alternatively, a heat-shrinkable sheet or tube may be used by heating and shrinking the sheet or tube and then applying it to the straight steel pipe 1. The thickness of the coating 8 should not exceed 5 mm, in the light of economics and its characteristics. In order to enhance the adhesion between the coating 8 and the steel material, the steel material may be chemical-conversion treated or a primer applied thereto by any appropriate method, prior to the coating.

The sprayed aluminum layer 9 protects the outer surface of the screw couplings 2 against the formation of rust, prior to installing the tendons, and also protects the ends of coating 8 comprised of resin material during the life of the tendons. An appropriate thickness of the sprayed aluminum layer 9 is from approximately 100 to 300 $\mu$m. The sprayed aluminum layer 9 can be formed on the screw couplings 2 by means of a flame spraying or arc method. The so formed sprayed aluminum layer 9 may be further subjected to sealing of the pores, if necessary. The sprayed aluminum layer 9 is sufficiently rigid that it will not be damaged by a fastening jig (tongue) which is engaged with the convex and concave parts of the screw coupling 2 for turning and securing the same to a steel pipe.

The galvanic current-anode 5 suppresses the dissolution of the sprayed aluminum layer 9 to the minimum, thereby maintaining the shielding effect of the sprayed aluminum layer 9. If any damage of the sprayed aluminum layer 9 and the coating 9 occurs, and hence the steel material of the screw coupling 2 is exposed, the galvanic current-anode 5 electrically protects the exposed surfaces against corrosion. Aluminum alloy, which is usually used for the galvanic current-anodes, is appropriate material for the galvanic current-anode 5 for the electrical corrosion protection of the tendons of a TLP.

According to an embodiment of the present invention, approximately 90% by area of the tendon is corrosion-protected by the coating 8 applied on the straight steel pipe, and approximately 10% by area of the tendon is corrosion-protected by the sprayed aluminum layer 9 applied on the screw coupling. The coating 8 will presumably be damaged over an area of approximately 5% of the total coated area during the life of tendon, which will lead to exposure of approximately 5% of the total coated area of the straight steel pipe 1 which is conductive. This conductive area and the other conductive area, i.e., the sprayed aluminum layer 9, must be protected by the galvanic current-anode 5. As described in the related arts, a net of 340 kg of aluminum is necessary for corrosion protection of an ordinary steel pipe for a tendon, provided that it is corrosion-protected exclusively by the galvanic current-anode. In the present embodiment the amount of aluminum required for corrosion protection is $340\times(0.1+0.9\times0.05)=49.3$ (kg). This means that the galvanic current-anode 5 is considerably smaller in size.

Figure 2B:
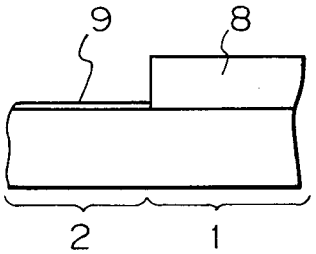
FIG. 2(B) is a cross sectional view taken along the line B—B of FIG. 2(A), and FIGS. 3(A), (B), and (C), and FIG. 4 illustrate the corrosion-protection method according to the present invention.
Figure 3A:
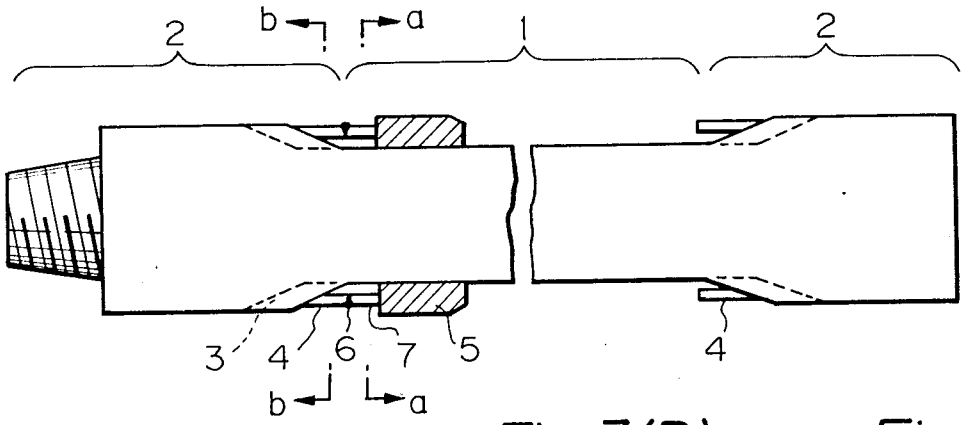
Figure 3B:
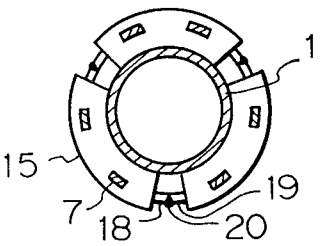
Figure 3C:
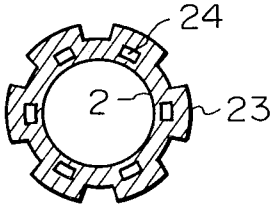
Figure 4:
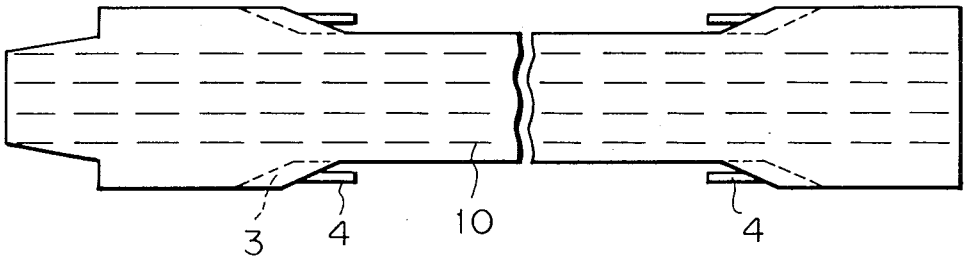

Referring to FIGS. 3(A), (B), and (C), the same parts of a tendon as those shown in FIGS. 1 and 2 are denoted by the same reference numerals. In the embodiment of the tendon shown in FIGS. 3(A), (B), and (C), the projections 4 are made of the same material as that of the screw coupling 2. The galvanic current-anode 5 comprises three fan-shaped aluminum sheets 15 which are connected via the core metal members 18 and 19. The core metal members 18 and 19 are attached to the respective ends of each fan-shaped aluminum sheet 15 and are welded to one another via the weld zone 20. The so connected, fan-shaped aluminum sheets 15 are in the form of a ring or so-called bracelet, and are wound around and attached to the straight steel pipe 1. The galvanic current-anode 5 is connected to the projections 4 through the weld zone 6. The core metal members 7 extend in parallel to the axial force exerted on the tendon. The ends of the core metal members 7 and the projections 4 are butt-welded at the weld zone 6. As shown in FIG. 3 (B), the core metal members 7 have a rectangular cross section. The cross sectional shape of the core metal members 7 is not limited to rectangular, but preferably, the cross sectional shape of the core metal members 7 is the same as that of the projections 4. When the galvanic current-electrode 6 is attached, the weld zone 6 is located outside the line 10 of stress exerted on the tendon, and, therefore, the weld zone 6 does not act as a notch causing the fatigue corrosion which results in the tendon destruction. The tension of a TLP is not exerted to the galvanic current-electrode 5, since it is merely attached, not welded, to the straight steel pipe 1. The welding of the galvanic current-electrode 5 is performed with the aid of the core metal members 7 which are butt-welded to the projections 4. The galvanic current-electrode 5 is therefore highly resistant to destruction due to movement of the TLP caused by wave action.

The projections 4, six of which are shown in the embodiment in FIGS. 3(A), (B), and (C), may be integral parts of the screw coupling 2 or may be parts connected to the screw coupling 2 by welding. These parts may be hardened and then tempered after the welding. Other methods may be employed for providing the projections 4, provided that the projections 4 do not act as notches with respect to the stress applied to the body of a tendon. The transitional region between the spline 3 and the projections 4, as well as the transitional region between the projections 4 and the weld zone 6, should not act as such a notch. From this view point, these transitional regions should evidently have a smooth contour and surface. Although there are six projections 4 and the galvanic current-anode 5 comprises three fan-shaped, members in the embodiment shown in FIGS. 3(A), (B), and (C), various modifications are possible with regard to the number of projections 4 and the separation of the electrode members, such as by using a pair of fan-shaped members or using an integral single annular member.

The present invention is further described by way of examples.

EXAMPLE 1

Five test pieces were manufactured by using five steel pipes having an outer diameter of 216.3 mm, thickness of 8.2 mm and length of 3 m. A circular cover was welded to each end of the steel pipes to protect the pipe interior from corrosion. The entire outer surface of the steel pipes was rough-blasted by steel grids. The so-prepared steel pipes were corrosion protected by five different methods to prepare the test pieces A through E, described below.

The test pieces A through E were exposed outdoors for six months, and their appearance was then observed. The test pieces A through E were subsequently entirely immersed in seawater besides a dike at the seashore. After a lapse of 2 years, the pieces were removed from the seawater and every part thereof was carefully scrutinized. The results are described as follows.

Test Piece A (Invention)

1. Construction

A. Central part of a test piece 2.8 m in length: a 0.2 mm thick film of two pack epoxy coating free of solvent plus a 2 mm thick film of urethane coating free of solvent.

B. Both ends of a pipe including circular covers: 0.2 mm thick aluminum sprayed layer formed by the arc method.

C. Aluminum-alloy anode: a bracelet type aluminum alloy anode 5 kg in weight was wound around the coating mentioned in item A, above, in such a manner that the ends of the coating and anode were aligned with one another. The core metal members of the anode were welded to sprayed aluminum coating.

2. Result

A. Coating of central part of a pipe: no occurrence of flaws; good adhesion of coating; and, no relief formation due to coating rise at part contiguous to sprayed aluminum layer.

B. Potential of sprayed aluminum layer was $-0.85 \sim -1.05$ volt vs. Ag/AgCl during the immersion in the sea water. No appreciable consumption of the sprayed aluminum layer occurred.

C. The aluminum alloy anode was consumed by approximately 0.1 kg.

Test Piece B (Invention)

1. Construction

A. Central part of a test piece 2.8 m in length: This part was treated by the coating type chromate solution and was then subjected to the powder-dispersion and fusion method for forming a polyethylene coating 0.2 mm in thickness.

B. Both ends of a pipe including circular covers: 0.2 mm thick sprayed aluminum layer formed by the arc method.

C. An aluminum-alloy anode: a bracelet type aluminum alloy anode 5 kg in weight was wound around the coating mentioned in item A, above, in such a manner that the ends of the coating and anode were aligned with one another. The core metal members of the anode were welded to the sprayed aluminum layer.

2. Result

A. Coating of the central part of a pipe: no occurrence of flaws; good adhesion of coating; and, no relief formation due to the coating rise at its part contiguous to the sprayed aluminum layer.

B. The potential of sprayed aluminum layer was $-0.85 \sim -1.05$ volt vs. Ag/AgCl during the immersion in sea water. No appreciable consumption of the sprayed aluminum layer occurred.

Test Piece C (Comparative Example)

1. Construction

A. Central part of test body 2.8 m in length: a 0.2 mm thick film of two pack epoxy coating free of solvent + a 2 mm thick film of urethane coating free of solvent.

B. Both ends of a pipe including circular covers: untreated.

C. An aluminum-alloy anode: a bracelet type aluminum alloy anode 5 kg in weight was wound around the coating mentioned in item A, above, in such a manner that the ends of the coating and anode were aligned with one another. The core metal members of the anode were welded to the pipe body.

2. Result

A. After exposure outdoors, remarkable rust formation occurred at the (non-coated) ends of the test piece. Pitting having a 0.5 mm depth at maximum occurred in the rust area. (Corrosion pits would act as notches and promote fatigue corrosion). At the ends of coating applied on the central part of pipe, local corrosion occurred beneath the coating.

B. After immersion in seawater, no damage of the coating apparently occurred on its surface, and the corrosion occurred on the uncoated parts during the exposure outdoors did not advance.

Test Piece D (Comparative Example)

1. Construction

One aluminum alloy electrode in a bracelet form, having net weight of 17 kg was wound around each of both ends of a pipe, and the core metal members were welded to the pipe body.

2. Results

A. After exposure outdoors for 6 months, remarkable rust formation occurred on the entire surface of the test body, and corrosion pits having a depth of 0.5 mm at maximum formed in the rust area.

B. After immersion in the seawater, the aluminum alloy anode was consumed by approximately 1 kg.

Test Piece E (Comparative Example)

1. Construction

A 0.075 mm thick, inorganic zinc-rich coating + a 0.15 mm thick solvent-type epoxy coating on the entire surface of the test piece (including covers).

2. Results

A. After exposure outdoors for 6 months no rust formation occurred but several tens of pin holes were detected on the coating.

B. After immersion in seawater a number of reliefs were detected on the coating. Rust formation was also detected. Corrosion pits were locally detected in the rust area.

Rust formation and pitting corrosion occurred due to the six months-outdoor exposure or the two years-undersea exposure in the comparative test pieces (C, D, and E). The pitting corrosion, if occurred on the tendons of a TLP, would promote fatigue corrosion. On the other hand, with regard to the test pieces A and B according to the present invention, neither outdoor or undersea exposure resulted in the rust formation and pitting corrosion. In addition, the consumption amount of an aluminum anode according to the present invention was considerably less than that in Test piece C.

Note, the surface area which was corrosion protected in the test pieces amounted to approximately one tenth that of the actual tendons of a TLP. The results described above would well conform to the corrosion protection of actual tendons of a TLP.

EXAMPLE 2

Three test pieces, approximately one third in size of the actual tendon of a TLP, were manufactured. The steel pipes of the test pieces were 196 mm in outer diameter, and 8.5 mm in wall thickness. The screw couplings were 203 mm in the largest outer diameter, and 200 mm in length. The total length of the test pieces was 2000 mm. The steel pipes were made of steel grade SM50B. The four convex and concave parts of the spline were formed on the screw coupling and were equi-spaced from each other. Two test pieces were provided with four projections in the form of a rod, having a rectangular cross-section, being 7 mm×14 mm in size, and protruding from the convex parts of the spline. The galvanic current anode was prepared by connecting a pair of ring halves, made of an aluminum sheet (1526 kg) 170 mm in inner diameter, 30 mm in thickness, and 30 mm in width, with one another by a pair of the metal core members which were attached to the respective aluminum sheets. An additional four metal core members were provided for connecting the galvanic current-anode to the projections mentioned above. Each two additional metal core members were fixed to the respective aluminum sheet. The six metal core members were made of steel. A pair of aluminum sheets were fitted around the steel pipe, and the metal core members for connecting the aluminum sheet were butt-welded. The aluminum anode, which was attached in the form of a ring around the steel pipe, was connected to a pipe by one of the following three methods.

Test Piece A (Comparative Sample)

In this test piece, the aluminum anode was rigidly secured to the outer surface of a pipe by directly fillet-welding the four metal core members to the outer surface of a pipe.

Test Piece B (Comparative Sample)

In this test piece, the aluminum anode was rigidly connected to the projections by overlapping the four metal core members of the anode and the four projections of the screw coupling over a length of 15 mm and then fillet-welding only the outer surface of the overlapped metal core members and projections.

Test Piece C (Invention)

In this test piece, the aluminum anode was rigidly connected to the projections by butt-welding and the metal core members of the aluminum anode via the 60° (groove angle)-grooves of the projections and metal core members.

The above three test pieces were subjected to the fatigue corrosion test in artificial sea water stipulated in an ASTM Standard. The tensile stress was applied to the three text bodies by the single swing axial tensile load method, in which the scope of stress was 200 $N/mm^2$ and the repetition speed was 0.5 Hz. The results of the fatigue corrosion test were as follows.

Test Piece A

The pipe ruptured at the repetition number of 210,834 due to cracks generated at the fillet weld.

Test Piece B

The test was stopped at the repetition number of 1,928,055 times. No cracks were generated on the steel pipe. Cracks were locally generated, however, in the fillet-welds between the metal core members of aluminum electrode and the projections.

Test Piece C

The test was stopped at the repetition number of 2,046,229 times. No cracks generated at all.

As is apparent from the above results, the resistance against fatigue corrosion is improved by using the connecting method of a galvanic current-anode according to the present invention, in which it is not directly, rigidly connected to the steel pipe and the screw coupling. In addition, butt-welding is more appropriate for welding the galvanic current anode to the screw coupling through the metal core members of the anode and the projections of the coupling, than is fillet welding, since cracks, which can result in a falling off of the galvanic current anode, are less liable to be generated in the butt welding than in the fillet welding.

We claim:

1. A tendon of a tension leg platform, comprising:

straight steel pipes having an outer surface and an inner surface;

screw couplings fastened on the straight steel pipes at their ends, each pair of which screw couplings being coupled with one another by threads;

convex and concave shaped, fastening means for fastening said screw couplings to the straight steel pipes, formed on an outer circumferential surface of said screw couplings;

an insulative, corrosion-protective coating formed on the outer surface of said straight steel pipes, having a damage resistance against any force exerted thereto prior to and during installation of the tendon as well as during service of the tendon;

a sprayed aluminum layer formed on an outer surface of each screw coupling and having ends contiguous to ends of said insulative, corrosion-protective coating; and a galvanic current anode attached to, and surrounding each straight steel pipe and electrically connected to said sprayed aluminum layer for electrically protecting it and also electrically connected to each straight steel pipe via said electrically connected sprayed aluminum layer, for electrically protecting any exposed area of said straight steel pipe during a service life of the tendon.

2. A tendon according to claim 1, further comprising a means for rigidly securing said galvanic current-anodes to said screw couplings, including at least one projection protruded from each convex shaped part of the screw couplings and at least one metal core member connected to the galvanic current-anode, said at least one projection and metal core member being butt-welded to each other at the ends thereof, and, said at least one projection member consists of the same material as that of the screw members.

3. A tendon according to claim 1 or 2, wherein said coating consists of epoxy resin and has a thickness of 0.2 mm or more.

4. A tendon according to claim 3, wherein said coating has a protective coating of epoxy resin, consisting of at least one member selected from the group consisting of polyurethane, polyester reinforced with glass, polymer cement or mortar, and resin mortar.

5. A tendon according to claim 1 or 2, wherein said coating consists of polyethylene and has a thickness of 1 mm or more.

6. A tendon according to claim 1 or 2, wherein said sprayed aluminum layer has a thickness of from approximately 100 μm to 300 μm.

7. A tendon according to claim 2, wherein said projections and said metal core members consist of steel.

* * * * *